US006645081B1

(12) United States Patent
Salas

(10) Patent No.: US 6,645,081 B1
(45) Date of Patent: Nov. 11, 2003

(54) SPRING ACTUATED POOL CUE

(76) Inventor: Albert Salas, 1616 S. Euclid Ave. #126, Anaheim, CA (US) 92802

( * ) Notice: Subject to any disclaimer, the term of this patent is extended or adjusted under 35 U.S.C. 154(b) by 0 days.

(21) Appl. No.: 10/103,936

(22) Filed: Mar. 22, 2002

(51) Int. Cl.[7] ..... A63D 15/08
(52) U.S. Cl. ..... 473/45
(58) Field of Search ..... 473/44–49

(56) References Cited

U.S. PATENT DOCUMENTS

| | | | | | |
|---|---|---|---|---|---|
| 673,693 | A | * | 5/1901 | Beaufils | 473/45 |
| 673,753 | A | * | 5/1901 | Beaufils | 473/45 |
| 690,945 | A | * | 1/1902 | Gray | 473/45 |
| 942,486 | A | * | 12/1909 | Dall | 473/45 |
| 1,054,830 | A | * | 3/1913 | Crabb | 473/45 |
| 1,062,816 | A | * | 5/1913 | Burwell | 473/45 |
| 1,122,589 | A | * | 12/1914 | Graff | 473/45 |
| 1,152,908 | A | * | 9/1915 | Robinette | 473/45 |
| 1,157,909 | A | * | 10/1915 | Teague | 473/45 |
| 1,241,312 | A | * | 9/1917 | Virnig | 473/45 |
| 1,604,023 | A | * | 10/1926 | Coyle | 473/45 |
| 3,246,895 | A | * | 4/1966 | Traill | 473/45 |
| 3,447,805 | A | * | 6/1969 | Baley, Jr. et al. | 473/45 |
| 3,711,093 | A | | 1/1973 | Evans | |
| 3,858,882 | A | | 1/1975 | Fox et al. | |
| 4,634,123 | A | | 1/1987 | Cowan et al. | |
| 4,688,796 | A | | 8/1987 | Wright | |
| 5,299,983 | A | * | 4/1994 | Pfost et al. | 473/45 |
| 5,554,075 | A | | 9/1996 | Glazer | |
| D391,327 | S | | 2/1998 | Golz | |
| 6,155,929 | A | * | 12/2000 | Chipman | 473/2 |

* cited by examiner

*Primary Examiner*—Mark S. Graham

(57) ABSTRACT

A spring actuated pool cue for teaching the strength of cue stroke and aiming of the cue. The spring actuated pool cue includes a cue having a first portion and a second portion. The fist and second portions each have a first end and a second end. The first end of the second portion has a bore extending therein. An intermediate wall extends across the bore. The second end of the first portion is extendable into the first end of second portion. A rod is attached to and extends outwardly away from the second end of the first portion of the cue. The rod extends through an opening in the intermediate wall. An urging means urges the first portion away from the intermediate wall into an extended position. The urging means is positioned between the intermediate wall and the second end of the first portion.

7 Claims, 2 Drawing Sheets

SPRING ACTUATED POOL CUE

BACKGROUND OF THE INVENTION

1. Field of the Invention

The present invention relates to pool cue devices and more particularly pertains to a new spring actuated pool cue for teaching the strength of cue stroke and aiming of the cue.

2. Description of the Prior Art

The use of pool cue devices is known in the prior art. More specifically, pool cue devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,634,123; 3,858,882; 4,688,796; 3,711,093; 5,554,075; and U.S. Des. Pat. No. 391,327.

While these devices fulfill their respective, particular objectives and requirements, the aforementioned patents do not disclose a new spring actuated pool cue. The inventive device includes a cue having a first portion and a second portion. The second portion has a first end and a second end. The first end of the second portion has a bore extending therein toward the second end of the second portion. An intermediate wall extends across the bore and is positioned generally between the first and second ends of the second portion. The first portion has a first end and a second end. The first end of the first portion defines a cue tip. The second end of the first portion is extendable into the first end of second portion. The first portion may be positioned between a retracted position and an extended position with relation to the second portion. A rod is attached to and extends outwardly away from the second end of the first portion of the cue. The rod extends through an opening in the intermediate wall. An urging means urges the first portion away from the intermediate wall into the extended position. The urging means is positioned between the intermediate wall and the second end of the first portion.

In these respects, the spring actuated pool cue according to the present invention substantially departs from the conventional concepts and designs of the prior art, and in so doing provides an apparatus primarily developed for the purpose of teaching the strength of cue stroke and aiming of the cue.

SUMMARY OF THE INVENTION

In view of the foregoing disadvantages inherent in the known types of pool cue devices now present in the prior art, the present invention provides a new spring actuated pool cue construction wherein the same can be utilized for teaching the strength of cue stroke and aiming of the cue.

The general purpose of the present invention, which will be described subsequently in greater detail, is to provide a new spring actuated pool cue apparatus and method which has many of the advantages of the pool cue devices mentioned heretofore and many novel features that result in a new spring actuated pool cue which is not anticipated, rendered obvious, suggested, or even implied by any of the prior art pool cue devices, either alone or in any combination thereof.

To attain this, the present invention generally comprises a cue having a first portion and a second portion. The second portion has a first end and a second end. The first end of the second portion has a bore extending therein toward the second end of the second portion. An intermediate wall extends across the bore and is positioned generally between the first and second ends of the second portion. The first portion has a first end and a second end. The first end of the first portion defines a cue tip. The second end of the first portion is extendable into the first end of second portion. The first portion may be positioned between a retracted position and an extended position with relation to the second portion. A rod is attached to and extends outwardly away from the second end of the first portion of the cue. The rod extends through an opening in the intermediate wall. An urging means urges the first portion away from the intermediate wall into the extended position. The urging means is positioned between the intermediate wall and the second end of the first portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new spring actuated pool cue apparatus and method which has many of the advantages of the pool cue devices mentioned heretofore and many novel features that result in a new spring actuated pool cue which is not anticipated, rendered obvious, suggested, or even implied by any of the prior art pool cue devices, either alone or in any combination thereof.

It is another object of the present invention to provide a new spring actuated pool cue which may be easily and efficiently manufactured and marketed.

It is a further object of the present invention to provide a new spring actuated pool cue which is of a durable and reliable construction.

An even further object of the present invention is to provide a new spring actuated pool cue which is susceptible of a low cost of manufacture with regard to both materials and labor, and which accordingly is then susceptible of low prices of sale to the consuming public, thereby making such spring actuated pool cue economically available to the buying public.

Still yet another object of the present invention is to provide a new spring actuated pool cue which provides in the apparatuses and methods of the prior art some of the advantages thereof, while simultaneously overcoming some of the disadvantages normally associated therewith.

Still another object of the present invention is to provide a new spring actuated pool cue for teaching the strength of cue stroke and aiming of the cue.

Yet another object of the present invention is to provide a new spring actuated pool cue which includes a cue having a first portion and a second portion. The second portion has a first end and a second end. The first end of the second portion has a bore extending therein toward the second end of the second portion. An intermediate wall extends across the bore and is positioned generally between the first and second ends of the second portion. The first portion has a first end and a second end. The first end of the first portion defines a cue tip. The second end of the first portion is extendable into the first end of second portion. The first portion may be positioned between a retracted position and an extended position with relation to the second portion. A rod is attached to and extends outwardly away from the second end of the first portion of the cue. The rod extends through an opening in the intermediate wall. An urging means urges the first portion away from the intermediate wall into the extended position. The urging means is positioned between the intermediate wall and the second end of the first portion.

Still yet another object of the present invention is to provide a new spring actuated pool cue that simultaneously teaches a user how hard to strike a cue ball and how backspin may be created.

Even still another object of the present invention is to provide a new spring actuated pool cue that teaches how strike area of a cue ball by a cue affects the spin and direction of the cue ball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
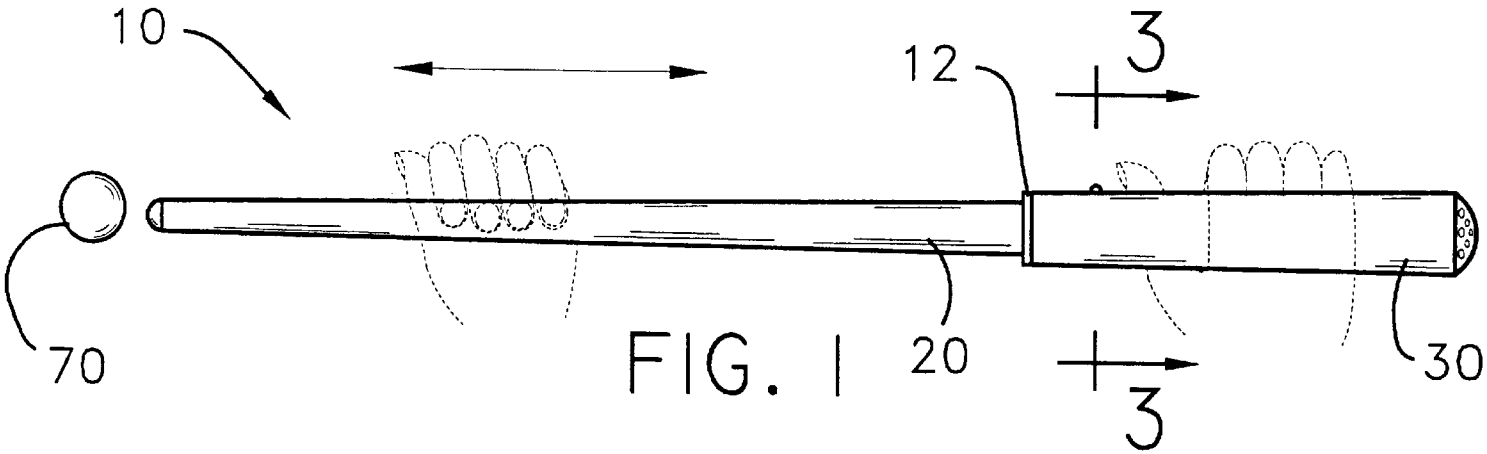
FIG. 1 is a schematic side view of a new spring actuated pool cue according to the present invention.
Figure 2:
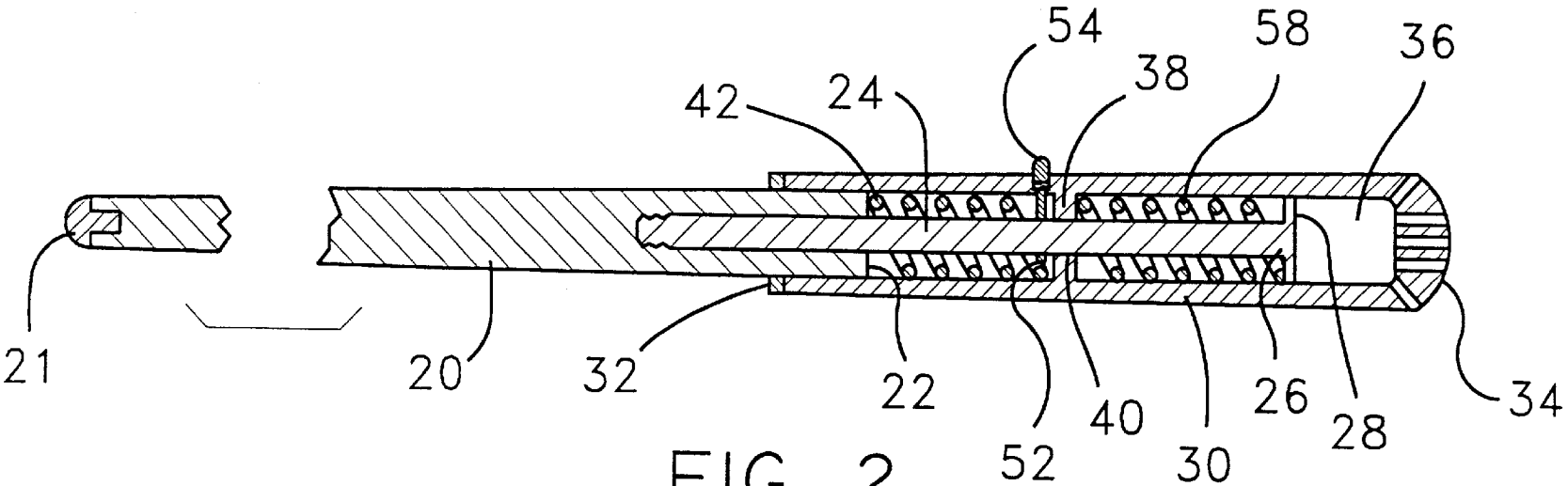
FIG. 2 is a schematic cross-sectional side view of the present invention.
Figure 3:
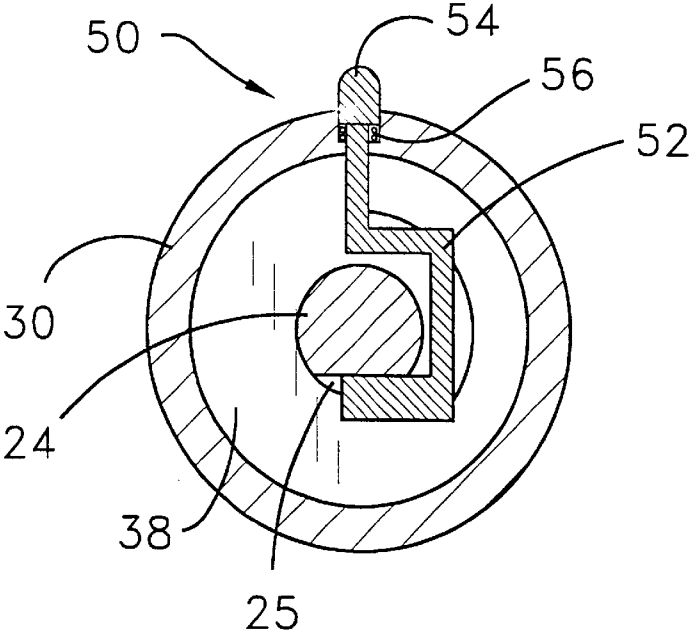
FIG. 3 is a schematic cross-sectional view taken along line 3—3 of FIG. 1 of the present invention.
Figure 4:
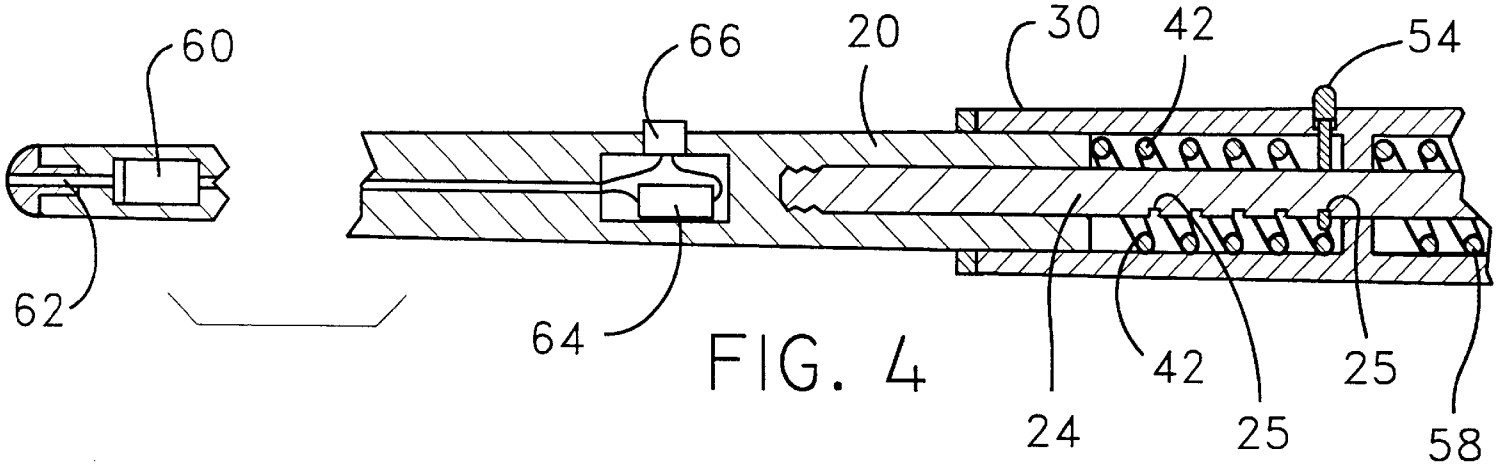
FIG. 4 is a schematic cross-sectional side view of the present invention.

With reference now to the drawings, and in particular to FIGS. 1 through 4 thereof, a new spring actuated pool cue embodying the principles and concepts of the present invention and generally designated by the reference numeral 10 will be described.

As best illustrated in FIGS. 1 through 4, the spring actuated pool cue 10 generally comprises a cue 12 having a first portion 20 and a second portion 30. The second portion 30 has a first end 32 and a second end 34. The first end 32 of the second portion 30 has a bore 36 extending therein toward the second end 34 of the second portion 32. An intermediate wall 38 extends across the bore 36 and is positioned generally between the first 32 and second 34 ends of the second portion 30. The first portion 20 has a first end 21 and a second end 22. The first end 21 of the first portion 20 defines a cue tip. The second end 22 is extendable into the first end 32 of second portion 30. The first portion 20 may be positioned between a retracted position and an extended position with relation to the second portion 30.

A rod 24 is attached to and extends outwardly away from the second end 22 of the first portion 20 of the cue 12. The rod 24 extends through an opening 40 in the intermediate wall 38. The rod 24 has a free end 26 extending toward the second end 34 of the second portion 30. A panel 28 is attached to the free end 26 of the rod 24.

An urging means 42 urges the first portion 20 away from the intermediate wall 38 into the extended position. The urging means 42 is positioned between the intermediate wall 38 and the second end 22 of the first portion 20. The urging means 42 comprises a spring wound about the rod 24 and extending between the intermediate wall 38 and the first portion 20 of the cue 12.

A locking means 50 selectively locks the first portion 20 in a retracted position. The locking means 50 extends through the second portion 30 and engages one of a plurality of slots 25 in the rod 24. The locking means 50 comprises a lever including a catch 52 and a button 54. The button 54 extends through the second portion 30 and into the bore 36. The button 54 is positioned generally adjacent to the intermediate wall 38. A biasing means 56 biases the button 54 outward of the bore 36. The catch 52 is positioned in the bore 36 and is attached to the button 54. The catch 52 generally extends around the rod 24 and is positionable in one of the slots 25 when the button 54 is outwardly biased.

A cushioning member 58 is positioned in the second portion 30 between the panel 28 and the intermediate wall 38. The cushioning member 58 comprises a spring wound about the rod 24 and biases the panel 28 away from the intermediate wall 38.

Preferably, a laser light emitting device 60 is positioned in the first portion 20. The cue tip 21 has a hole 62 therein extending to the laser light emitting device 30 such that laser light may be emitted through the cue tip 21. The hole 62 is generally co-axial with a longitudinal axis of the first portion 20. A power supply 64 is operationally coupled to the laser light emitting device 60. The power supply 64 is mounted in the first portion 20 and ideally comprises a removable battery. An actuator 66 selectively turns the laser light emitting device 60 on and off. The actuator 66 is mounted on the first portion 20 and is operationally coupled to the power supply 64.

In use, the device 10 is used primarily for teaching a person how hard to strike a cue ball 70 and how to aim at the cue ball 70. The user pulls the first portion 20 into the second portion 32 and locks the catch 52 in the desired slot 25 of the rod 24. The button 54 is then pressed which releases the catch 52 from the rod 24 and allows the urging means 42 to force the first portion 20 away from the intermediate wall 38. The cushioning member 58 prevents the panel 28 from striking the intermediate wall 38, and causes the first portion 20 to snap back quickly which teaches a user how to create backspin on a cue ball 70. The laser emitting device 60 shows a user where they are going to strike the cue ball 70. By practicing different strike points, the user will learn how to place a desired spin on the cue ball 70.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A spring actuated cue comprising:

a cue having a first portion and a second portion, said second portion having a first end and a second end, said first end of said second portion having a bore extending therein toward said second end of said second portion, an intermediate wall extending across said bore and being positioned generally between said first and second ends of said second portion, said first portion having a first end and a second end, said first end of said first portion defining a cue tip, said second end of said first portion being extendable into said first end of second portion, wherein said first portion may be positioned between a retracted position and an extended position with relation to said second portion;

a rod being attached to and extending outwardly away from said second end of said first portion of said cue, said rod extending through an opening in said intermediate wall;

an urging means for urging said first portion away from said intermediate wall into said extended position, said urging means being positioned between said intermediate wall and said second end of said first portion; and wherein said rod has a free end extending toward said second end of said second portion, a panel being attached to said free end of said rod, a cushioning member being positioned in said second portion between said panel and said intermediate wall, said cushioning member comprising a spring wound about said rod and biasing said panel away from said intermediate wall.

2. The spring actuated cue as in claim 1, wherein said urging means comprises a spring wound about said rod and extending between said intermediate wall and said first portion of said cue.

3. The spring actuated cue as in claim 1, further including a locking means for selectively locking said first portion in a retracted position, said locking means extending through said second portion and engaging one of a plurality of slots in said rod.

4. The spring actuated cue as in claim 3, wherein said locking means comprises a lever including a catch and a button, said button extending through said second portion and into said bore, said button being positioned generally adjacent to said intermediate wall, a biasing means biases said button outward of said bore, said catch being positioned in said bore and being attached to said button, said catch generally extending around said rod and being positionable in one of said slots when said button is outwardly biased.

5. The spring actuated cue as in claim 1, further including a laser light emitting device being positioned in said first portion, said cue tip having a hole therein extending to said laser light emitting device such that laser light may be emitted through said cue tip, said hole being generally co-axial with a longitudinal axis of said first portion, a power supply being operationally coupled to said laser light emitting device, said power supply being mounted in said first portion.

6. The spring actuated cue as in claim 5, further including an actuator for selectively turning said laser light emitting device on and off, said actuator being mounted on said first portion and being operationally coupled to said power supply.

7. A spring actuated cue comprising:

a cue having a first portion and a second portion, said second portion having a first end and a second end, said first end of said second portion having a bore extending therein toward said second end of said second portion, an intermediate wall extending across said bore and being positioned generally between said first and second ends of said second portion, said first portion having a first end and a second end, said first end of said first portion defining a cue tip, said second end of said first portion being extendable into said first end of second portion, wherein said first portion may be positioned between a retracted position and an extended position with relation to said second portion;

a rod being attached to and extending outwardly away from said second end of said first portion of said cue, said rod extending through an opening in said intermediate wall, said rod having a free end extending toward said second end of said second portion, a panel being attached to said free end of said rod;

an urging means for urging said first portion away from said intermediate wall into said extended position, said urging means being positioned between said intermediate wall and said second end of said first portion, said urging means comprising a spring wound about said rod and extending between said intermediate wall and said first portion of said cue;

a locking means for selectively locking said first portion in a retracted position, said locking means extending through said second portion and engaging one of a plurality of slots in said rod, said locking means comprising a lever including a catch and a button, said button extending through said second portion and into said bore, said button being positioned generally adjacent to said intermediate wall, a biasing means biases said button outward of said bore, said catch being positioned in said bore and being attached to said button, said catch generally extending around said rod and being positionable in one of said slots when said button is outwardly biased;

a cushioning member being positioned in said second portion between said panel and said intermediate wall, said cushioning member comprising a spring wound about said rod and biasing said panel away from said intermediate wall; and a laser light emitting device being positioned in said first portion, said cue tip having a hole therein extending to said laser light emitting device such that laser light may be emitted through said cue tip, said hole being generally co-axial with a longitudinal axis of said first portion, a power supply being operationally coupled to said laser light emitting device, said power supply being mounted in said first portion, an actuator for selectively turning said laser light emitting device on and off, said actuator being mounted on said first portion and being operationally coupled to said power supply.

* * * * *